United States Patent [19]

George et al.

[11] Patent Number: 4,830,186

[45] Date of Patent: May 16, 1989

[54] COPY SHEET PREPACKAGED, SHIPPING AND LOADING WRAPPER FOR USE IN A HIGH VOLUME DUPLICATOR

[75] Inventors: Clifford L. George, Macedon; Richard H. Nagel, Pittsford, both of N.Y.

[73] Assignee: Xerox Corporation, Stamford, Conn.

[21] Appl. No.: 748,290

[22] Filed: Jun. 24, 1985

[51] Int. Cl.[4] ..... B65D 85/62

[52] U.S. Cl. ..... 206/449

[58] Field of Search ..... 206/449, 451, 215

[56] References Cited

U.S. PATENT DOCUMENTS

| | | | |
|---|---|---|---|
| 2,011,236 | 8/1935 | Winter et al. | 206/449 |
| 2,199,676 | 5/1940 | Salsman | 206/449 |
| 2,207,917 | 7/1940 | Fleischer | 206/449 |
| 2,956,674 | 10/1960 | Weilby | 206/451 |
| 3,317,487 | 2/1968 | Dwyer, Jr. | 206/449 |
| 4,444,315 | 4/1984 | Gaskill, Jr. | 206/449 |
| 4,540,614 | 9/1985 | Omori | 206/451 |

*Primary Examiner*—Stephen Marcus

*Attorney, Agent, or Firm*—William A. Henry, II

[57] ABSTRACT

A disposable wrapper is disclosed which is adapted to hold a supply of copy sheets in the form of a pack equivalent to a plurality of reams for a printing machine. The wrapper is constructed of two main portions which permit the operator to carry the stack to a sheet supply platform for the machine without disrupting the stack. One of the portions of the wrapper stiffens the pack and serves to permit the operator to carry and place the stack upon the platform. The other portion is in the form of a flexible strip wrapped around the pack and which may be slidably removed from under the stack thus effecting the loading of the stack in the printing machine preparatory to the sheet feed operation.

2 Claims, 3 Drawing Sheets

11
12
13
15
16
17
18
P

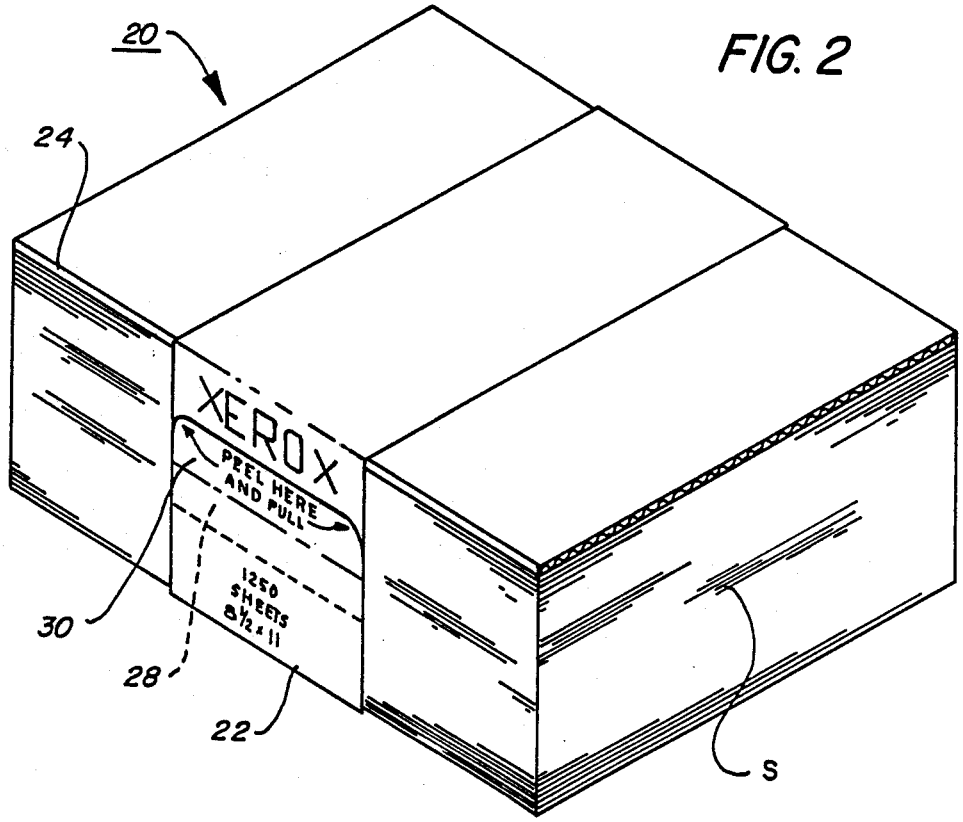
FIG. 2
FIG. 3
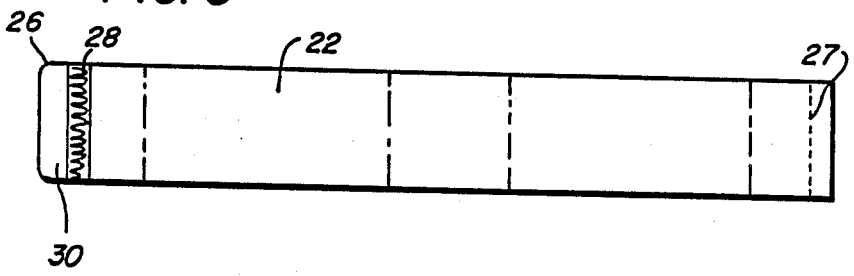

COPY SHEET PREPACKAGED, SHIPPING AND LOADING WRAPPER FOR USE IN A HIGH VOLUME DUPLICATOR

This invention relates to a high productivity reproduction system, or copying machine, having copy sheet supply arrangements involving very large quantities of copy sheets for use in such system.

With the advent of higher speed and more sophisticated copy producing machines, printing presses, and the like, considerations as to how the mass of copy sheet supply can best and most effectively be handled has assumed increasing importance. For high productivity copiers or duplicators, copy sheet supply apparatus utilize supply trays which are adapted to hold three to five and even more reams of copy sheets. This type of copy sheet supply requires the operator to load the paper supply tray with a plurality of prepackaged reams of copy sheets, one ream at a time, thereby necessitating repeatedly shutting down the duplicator for a considerable length of time so as to permit the breaking open of the prepackaged reams and loading of the sheet supply tray with the individually handled reams of sheets. This entailed unpackaging individual reams and placing each ream on the elevator platform for the sheet supply using caution that each ream of sheets is correctly placed on an earlier placed ream. Building up a supply tray holding five or more reams involved time which required machine shutdown and consequently loss of productivity as well as requiring many manipulative steps by the operator to accomplish.

A bulk package of copy sheets is disclosed in U.S. Pat. No. 3,367,487 and is adapted to be placed on the delivery platform of a copier. However, the disclosed carton does not lend itself to be dismantled while on a copier platform which is deeply recessed into the copier. The disclosed carton merely provides the operator with many reams of paper which is placed on the platform, and evidently left there for the dispensing of sheets. The package in such operative position cannot be used in printing machines having a bottom sheet feeder or a top feeder working in conjunction with an upwardly movable elevator. In the latter use, the package would become crushed between the elevator platform and the internal structure of the machine, thereby potentially damaging the machine, and in any event causing sheet jamming.

It is, therefore, the object of the present invention to permit the loading of a very high speed printing machine such as a copier or duplicator with a supply of copy sheets quickly and easily and to eliminate copier shutdown for this purpose.

The present invention includes a copy sheet wrapper assembly adapted for shipping and dispensing and capable of being loaded during assembly and manufacturing with sheets of paper equivalent to a plurality of reams of copy sheets. The wrapper assembly may be applied directly to the sheet supply for a printing machine such as being placed upon the platform of the sheet feeding apparatus for the machine. Means are provided so that the portions of the wrapper which were placed on the platform with the stack can be removed so that the stack and the sheet feeding apparatus are cleared of these portions during operation.

Other objects and advantages will be apparent from the ensuing description and drawings in which:

FIG. 2 is an isometric of the shipping and dispensing wrapper assembly of the present invention;

FIG. 3 is a diagrammatic view of the blank from which the wrapper is formed;

Figure 1:
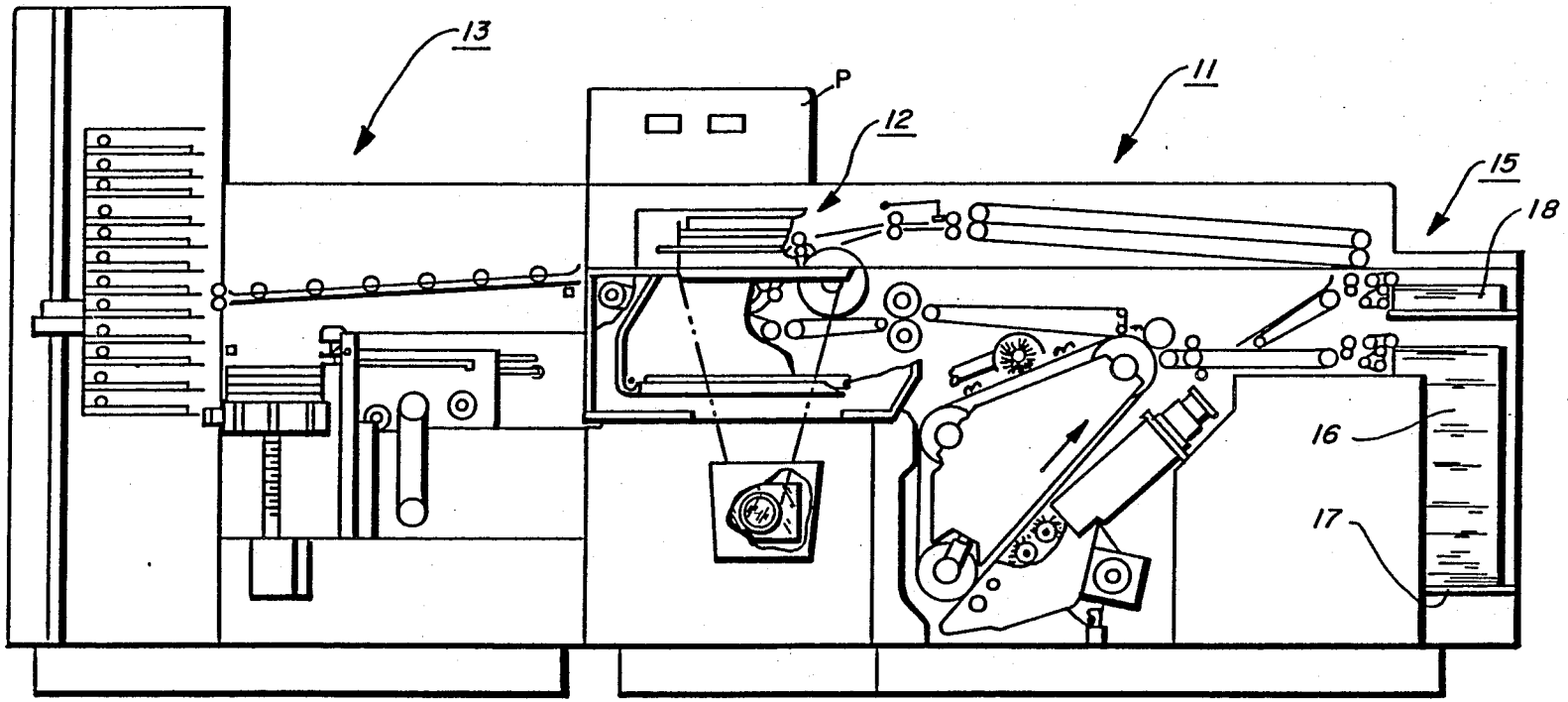
FIG. 1 is a schematic illustration of a configuration of an electrostatographic printing system to which the present invention may be utilized.

For a general understanding of a reproduction machine with which the present invention may be incorporated, reference is made to FIG. 1 wherein components of a typical electrostatic printing system are illustrated. The printing system is preferably of the xerographic type as one including a xerographic processor 11, and a document handling apparatus 12. Preferably, the processor 11 is the same as the processor in the commerical embodiment of the Xerox duplicators, models 9400® and 9500® which utilize flash, full frame exposure, for very high speed production. Similarly, the document handling apparatus 12 is the same as those used in the same machines. It will be understood that most any other type of xerographic processor and multiple exposure document handling apparatus may be utilized. Operating in conjunction with the processor 11 and apparatus 12 is a finishing station 13 and thereby forms the reproduction system shown in FIG. 1. It is understood that any other type of printing machine may incorporate or use the present invention.

The system comprising the processor 11 and the document handling apparatus 12 is under control of a programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode, stapled or unstapled; to select one of a plurality of paper trays; to condition the machine for the type of document, that is, whether one sided or two sided, to select a copy size reduction mode, and other desirable functions. The programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but preferably the processor is one similar to the Intel 8080 microprocessor manufactured by the Intel Corporation, Santa Clara, Calif., and having sufficient ROM's and RAM's for all the necessary functions in the reproduction system.

The copier/duplicator system shown in FIG. 1 is representative of systems which are capable of producing 120 and more image impressions per minute. For simplex or one sided copying, this can result in producing 120 copies per minute or more. In order to accomplish fairly long reproduction runs, the main copy sheet supply subsystem for the system, the main copy sheet holding tray is adapted to hold five reams of sheets. At 500 sheets per ream, five reams totals out to involve 2500 sheets. At a production rate of 120 copies per minute, it can be estimated that five reams will last approximately 21 minutes before needing reloading.

For a long run, it can be envisioned that an operator will spend considerable time reloading the main sheet supply tray.

Reloading five reams requires that the copying system be shut down, that each ream must be broken open and the sheets accurately positioned on the tray bottom for the sheet supply tray, which is usually an elevator platform. Generally, these platforms are only inches from the floor and are deeply recessed into the copier housing thus necessitating many cycles of up and down bending and leaning of the operator's body to accomplish a little over 21 minutes of copier use before another cycle of reloading will be required. The present invention is directed to a sheet holding wrapper assembly which is particularly suited to be placed upon the sheet supply platform or tray of a copier. The assembly is provided with a removable wrapper and a top stiffner plate positioned above a relatively large number of copy sheets previously inserted during manufacturing of the copy sheets so that upon removal of the wrapper and the plate, the prepackaged copy sheets will be exposed upon the supply tray in proper orientation and in a neat stack. It is envisioned in the copier system disclosed herein that the copy sheet supply platform can support about 2500 sheets. The wrapper and stiffner board together with the sheets were preferably packaged by a copy sheet paper manufacturer as a unitary package of paper much the same as a packaged ream is manufactured.

The sheet holding wrapper assembly in the present invention may be loaded while the copier is running with the use of an auxiliary sheet supply while copy sheets can be quickly added in multiples of 750–1500 sheets.

As shown in FIG. 1, the copier/duplicator system 11, 12 and 13 is typically provided with a copy sheet supply station 15 at one end of the system. This station may include a main sheet supply 16 having an elevator platform 17 which serves as the support or holding tray for five or more reams of copy sheets, and an auxiliary tray 18 which may contain one ream. In the conventional manner, the main sheet supply includes the elevator platform 17 upon which five or more reams of copy sheets are placed.

The loaded or prepackaged sheet supply wrapper assembly of the present invention is shown in FIG. 2 and denoted generally by the reference numeral 20. The assembly comprises a wrapper band 22 applied tightly around a stack of copy sheets S of copy previously loaded during manufacturing, the particular illustrated embodiment of assembly 20 being adapted to contain 750–1250 sheets, equivalent to 1½ to 2½ reams of paper. Above sheets S a stiffener plate 24 is positioned and held thereon by the band 22 with the edges thereof in general registry with the top edges of the stack.

The wrapper band 22, made of flexible material, preferably plastic material such as P.V.C., is wrapped around the sheets S along the longitudinal dimension for about a third of the length thereof. The band 22 may also be made of paper having adequate strength characteristics. As shown in FIG. 2, the band generally covers the middle third of the stack S. One end section 26 of the band overlaps the other end 27 thereof during storing, transporting and applying the wrapper assembly to the platform 17 of the feeding apparatus 15.

A suitable tear strip adhesive material 28 is positioned to a portion of the end section 26, and when applied to the other end 27 during fabrication of the wrapper assembly with the stack S, the two ends become tightly held thereby permitting the band 22 to secure the sheets of the stack in tightly held registration. If P.V.C. material is utilized for the band 22, a heat seal may be applied as the tear strip material 28. A flap portion 30 at the extreme end of the band adjacent the tear strip adhesive 28 permits an operator to remove the band 22 and panel 24 by manually tearing the end 26 from the portion of the band placed thereagainst.

When assembled as shown in FIG. 2, the wrapper 20 may be lifted by the operator with both hands positioned under the ends of the stack S. Since the band 22 is tightly applied to the stack, and consequently the stiffener panel 24, the latter, which may be made of ordinary corrugated carton material, will prevent the stack from bending and thereby fall from and between the operator's hands.

In operation, the operator lifts the assembly 20 and stack S and places the same upon the lowered platform 17 of the sheet feeding apparatus 15. The tear strip tab 30 is then stripped from the adjacent portion of the band 22 until free thereof. The entire band may now be manually slid from underneath the stack and disposed with. Final removal of the stiffening panel 24 presents the entire stack S to the apparatus 15 in readiness for feeding operation. Since the illustrated duplicator is capable of holding 2500 sheets of paper or five reams, the operator may load still another wrapper assembly of 1250 sheets in the same manner.

Figure 4:
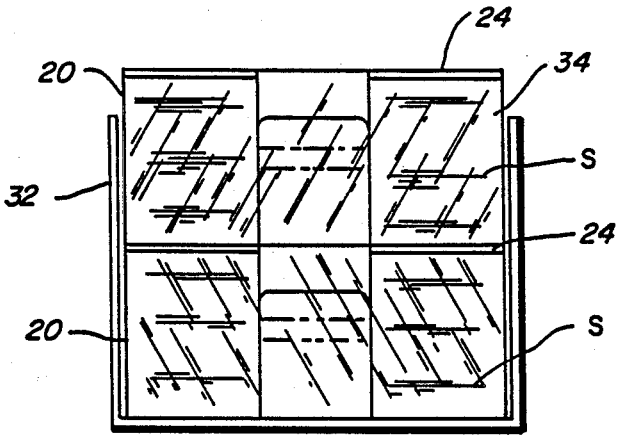
FIG. 4 is an elevational view of a mini-package of two wrapper assemblies one above the other arranged for storage and shipment.
Figure 5:
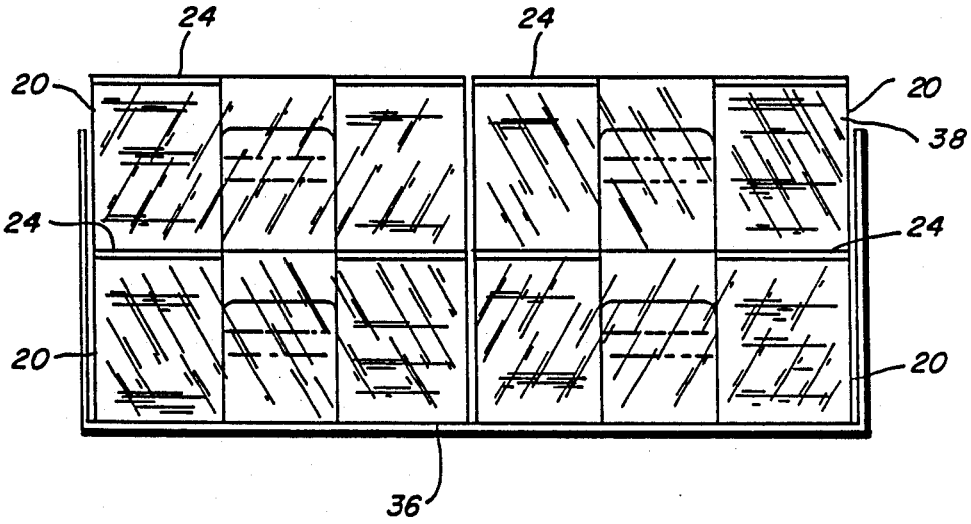
FIG. 5 is an elevational view of four wrapper assemblies arranged in cluster form in a shipping base carton.

In FIG. 4, two wrapper assemblies and stacks S, one above the other with total sheet supply of 2500 sheets, are shown as a unit which may be manufactured as such, stored, transported, and loaded. Such a unit may be contained in an open-top carton 32 with each stack S being surrounded by shrink-wrapper material 34 for moisture protection. In the alternative, four wrapper assemblies and stacks may be combined as a unit, as shown in FIG. 5, to resemble the conventional 10 ream carton. The four assemblies and stacks are held in an open-top carton 36 and each has shrink-wrap material 38 applied thereto.

From the foregoing, it will be appreciated that the present invention provides a quick and easy means for loading large quantities of copy sheets into a sheet feeding apparatus of a printing machine. Particularly significant is the provision of removable structural components of a wrapper which permits this loading in a feeding apparatus which is deeply recessed in the copier structure thus making it difficult to load even at the conventional rate of one ream at a time. The wrapper has been devised to be easily and quickly loaded with copy sheets at the manufacturer's plant and to be easily and quickly disassembled by the operator during loading. The configuration of the wrapper assembly improves loading time, paper handling operations, requires fewer ream interfaces which can be a source of paper feed jams or misfeeds, and involves lower costs.

While the invention has been described with reference to the structure disclosed, it is not confined to the details set forth, but is intended to cover such modifications or changes as may come within the scope of the following claims.

We claim:

1. A disposable wrapper assembly adapted for shipping, storage and presenting a large stack of copy sheets for use in a printing machine having a sheet feeding apparatus and a sheet supply platform for supporting copy sheets, comprising, a stiffener panel positioned across and above the stack of sheets and in general registry with the top edges thereof, a removable flexible band encircling the stack of sheets with said panel thereon intermediate and spaced from opposed ends thereof and having one end overlapping the other end, said band having means for detachably securing said one end to another portion thereof, said panel having a stiffness to prevent bending of the stack when the wrapper assembly is picked up at said opposed ends of the stack, said wrapper assembly and stack being adapted to be manually positioned upon the platform, and means for permitting the operator to detach said one end from said band and to remove the same and said panel from the stack and thereby effect the placement of the stack of sheets in operating association with the sheet feeding apparatus.

2. The disposable carton of claim 1 wherein said means for permitting the operator to remove said band comprises a manually operable means connected to said band.

* * * * *